US010098392B2

(12) United States Patent
Greenacre

(10) Patent No.: US 10,098,392 B2
(45) Date of Patent: Oct. 16, 2018

(54) GLOVE

(71) Applicant: SEALSKINZ LIMITED, Norfolk (GB)

(72) Inventor: Robert James Greenacre, Norfolk (GB)

(73) Assignee: SEALSKINZ LIMITED, Norfolk (GB)

( * ) Notice: Subject to any disclaimer, the term of this patent is extended or adjusted under 35 U.S.C. 154(b) by 178 days.

(21) Appl. No.: 14/783,176

(22) PCT Filed: Mar. 27, 2014

(86) PCT No.: PCT/GB2014/050984
§ 371 (c)(1),
(2) Date: Oct. 8, 2015

(87) PCT Pub. No.: WO2014/167289
PCT Pub. Date: Oct. 16, 2014

(65) Prior Publication Data

US 2016/0066633 A1 Mar. 10, 2016

(30) Foreign Application Priority Data

Apr. 10, 2013 (GB) ..... 1306527.1
Apr. 10, 2013 (GB) ..... 1306528.9
Feb. 11, 2014 (GB) ..... 1402300.6

(51) Int. Cl.
*A41D 19/00* (2006.01)
*A63B 71/14* (2006.01)

(52) U.S. Cl.
CPC ..... *A41D 19/0006* (2013.01); *A41D 19/001* (2013.01); *A63B 71/141* (2013.01); *A41D 2400/22* (2013.01)

(58) Field of Classification Search
CPC ..... A41D 19/0006; A41D 19/001; A41D 2400/22; A63B 71/141
See application file for complete search history.

(56) References Cited

U.S. PATENT DOCUMENTS 2,446,921 A * 8/1948 Grant ..... A41D 19/0065 2/168
4,918,756 A * 4/1990 Grilliot ..... A41D 19/01529 2/159

(Continued)

FOREIGN PATENT DOCUMENTS

EP 1635665 3/2006
EP 1680656 7/2006

(Continued)

OTHER PUBLICATIONS

U.S. Appl. No. 14/783,150, filed Oct. 8, 2015, Greenacre.

(Continued)

*Primary Examiner* — Khaled Annis
(74) *Attorney, Agent, or Firm* — Sheridan Ross PC

(57) ABSTRACT

A method of manufacturing a breathable waterproof glove, the method comprising: providing an inner glove layer (30) in a stretched configuration over an oversized glove former (20); while the inner glove layer (30) is in the stretched configuration adhering the inner glove layer (30) to an inner surface of an intermediate glove layer (40) resistant to penetration by liquid water but permeable to water vapour at a plurality of discrete securement locations to form an intermediate glove part in a stretched configuration,the intermediate glove layer defining a first plurality of finger portions (46); providing an outer glove part defining a second plurality of finger portions; and attaching using interconnecting securement tabs (48) the first plurality of finger portions (46) to the second plurality of finger portions formed on the outer glove layer such that each one of the finger portions of the first plurality is registered with a corresponding one of the finger portions of the second plurality.

14 Claims, 9 Drawing Sheets

(56) References Cited

U.S. PATENT DOCUMENTS

| | | | | |
|---|---|---|---|---|
| 5,123,119 | A | 6/1992 | Dube | |
| 5,244,716 | A | 9/1993 | Thornton et al. | |
| 5,349,705 | A | 9/1994 | Ragan | |
| 5,655,226 | A | 8/1997 | Williams | |
| 5,822,795 | A | 10/1998 | Gold | |
| 6,139,929 | A | 10/2000 | Hayton et al. | |
| 9,072,325 | B2 * | 7/2015 | Ragan | A41D 19/0006 |
| 2010/0077533 | A1 * | 4/2010 | Munda | A41D 19/001 2/161.1 |
| 2010/0154099 | A1 | 6/2010 | Lee | |
| 2011/0179549 | A1 * | 7/2011 | Zaggl | A41D 19/01547 2/93 |
| 2011/0214221 | A1 * | 9/2011 | Munda | A63B 71/14 2/161.1 |
| 2013/0007997 | A1 | 1/2013 | Morlacchi | |
| 2014/0310848 | A1 * | 10/2014 | Ulriksen | A41D 27/285 2/69 |

FOREIGN PATENT DOCUMENTS

| | | |
|---|---|---|
| GB | 2209658 | 5/1989 |
| GB | 2444475 | 6/2008 |
| WO | WO 89/07523 | 8/1989 |
| WO | WO 95/32093 | 11/1995 |
| WO | WO 98/19569 | 5/1998 |

OTHER PUBLICATIONS

International Search Report for International (PCT) Patent Application No. PCT/GB2014/050981, dated Jul. 18, 2014, 4 pages.
Written Opinion for International (PCT) Patent Application No. PCT/GB2014/050981, dated Jul. 18, 2014, 8 pages.
Preliminary Report on Patentability for International (PCT) Patent Application No. PCT/GB2014/050981, dated Oct. 13, 2015, 9 pages.
Preliminary Report on Patentability for International (PCT) Patent Application No. PCT/GB2014/050984, dated Oct. 13, 2015, 11 pages.
International Search Report for GB Patent Application No. 1306519.8, dated Oct. 16, 2013, 5 pages.
International Search Report for GB Patent Application No. 1306520.6, dated Oct. 16, 2013, 3 pages.
UK Search Report dated Oct. 14, 2013 for Great Britain Application No. GB 1306527.1.
Uk Search Report dated Sep. 30, 2013 for Great Britain Application No. GB 1306528.9.
International Search Report and Written Opinion prepared by the European Patent Office dated Jul. 10, 2014, for International Application No. PCT/GB2014/050984.

* cited by examiner

GLOVE

CROSS REFERENCE TO RELATED APPLICATIONS

This application is a national stage application under 35 U.S.C. 371 and claims the benefit of PCT Application No. PCT/GB2014/050984 having an international filing date of Mar. 27, 2014, which designated the United States, which PCT application claims the benefit of Great Britain Application No. 1306527.1 filed Apr. 10, 2013, Great Britain Application No. 1306528.9 filed Apr. 10, 2013, and Great Britain Application No. 1402300.6 filed Feb. 11, 2014, the disclosures of each of which are incorporated herein by reference.

The present invention relates to breathable waterproof gloves, and particularly but not exclusively to gloves intended for use during outdoor recreation or outdoor sports.

In accordance with a first aspect of the present invention, there is provided a method of manufacturing a breathable waterproof glove, the method comprising: providing an inner glove layer in a stretched configuration over an oversized glove former; while the inner glove layer is in the stretched configuration adhering the inner glove layer to an inner surface of an intermediate glove layer resistant to penetration by liquid water but permeable to water vapour at a plurality of discrete securement locations (e.g. to form a discontinuous pattern of securement locations between the inner glove layer and the intermediate glove layer to enable folding of the intermediate glove layer relative to the inner glove layer) to form an intermediate glove part in a stretched configuration, the intermediate glove layer defining a first plurality of finger portions; providing an outer glove part defining a second plurality of finger portions; and attaching using interconnecting securement tabs the first plurality of finger portions to the second plurality of finger portions formed on the outer glove layer such that each one of the finger portions of the first plurality is registered with a corresponding one of the finger portions of the second plurality.

In this way, a method of manufacturing a waterproof breathable (and windproof) glove is provided in which the glove includes an intermediate glove layer that is waterproof (e.g. resistant to penetration by liquid water under normal conditions during wear) but breathable and allows significant stretching of the inner glove layer (e.g. by at least 5% in at least one direction, for example by at least 10% in at least one direction, at least 20% in at least one direction or at least 30% in at least one direction) whilst providing a secure connection between the first and second plurality of finger portions.

In one embodiment the method comprises forming the inner glove layer in a stretched configuration over the oversized glove former and while the inner glove layer is in the stretched configuration providing the intermediate glove layer adjacent the inner glove layer (e.g. over the inner glove layer).

In one embodiment, the securement tabs are formed from an elastic material (e.g. an elastic fabric, such as an elastic woven fabric or elastic fabric tape).

In one embodiment, the step of attaching the outer glove layer to the intermediate glove part is performed whilst the intermediate glove part is in a relaxed configuration (e.g. after removal from the oversized glove former).

In a first arrangement, each securement tab is connected at a first end to its respective one of the first plurality of finger portions by an adhesive connection.

In one embodiment, each securement tab is connected at a second end (e.g. opposite to the first end) to its respective one of the second plurality of finger portions by a sewn connection.

In a second arrangement, each securement tab is connected to its respective one of the first plurality of fingers at first and second mutually spaced locations to form a loop.

In one embodiment, each securement tab is connected at a central part of the loop (e.g. between the first and second mutually spaced locations) to its respective one of the second plurality of finger portions (e.g. by a sewn connection). In one embodiment, the central part of the loop is spaced from its respective one of the first plurality of fingers (e.g. separated from its respective one of the first plurality of fingers by an opening).

In one embodiment, the first and second mutually spaced locations are on opposed sides each of the first plurality of fingers (e.g. opposed front and rear sides or opposed lateral sides).

In one embodiment, each securement tab is connected to its respective one of the first plurality of fingers at the first and second mutually spaced locations by first and second adhesive connections respectively.

In both the first and second arrangements, the step of attaching the securement tabs to each of the first plurality of finger portions may comprise attaching the securement tabs to each of the first plurality of finger portions during the step of adhering the inner glove layer to the inner surface of the intermediate glove layer. For example, the attachment step may comprise a two-stage process with a first stage in which a degree of attachment occurs prior to the step of adhering the inner glove layer to the intermediate glove layer and a second stage in which full attachment occurs during the step of adhering the inner glove layer to the intermediate glove layer (e.g. by activating an adhesive (e.g. heat activated adhesive) provided between the securement tabs and the intermediate glove layer).

In a third arrangement, each securement tab extends through the intermediate glove layer (e.g. through its respective one of the first plurality of fingers).

In one embodiment, each securement tab is connected at a first end to the inner glove layer (e.g. to a respective one of a third plurality of finger portions formed on the inner glove layer in registration with the finger portions of the first plurality)(e.g. by a sewn connection).

In one embodiment, each securement tab is connected at a second end (e.g. opposite to the first end) to its respective one of the second plurality of finger portions (e.g. by a sewn connection).

In one embodiment, the intermediate glove layer is formed by connecting a plurality of discrete parts (e.g. with the discrete parts being welded together (e.g. radio frequency, ultrasonic or hot-bar welded) to form a glove layer that is resistant to penetration by liquid water) and each securement tab extending through the intermediate glove layer is connected to the intermediate glove layer during connection of the plurality of discrete parts. For example, the first plurality of fingers may be formed by connecting first and second discrete parts (e.g. front and rear parts of the intermediate glove layer defining respectively front and rear sections of the third plurality of fingers portions) and each securement tab extending through the intermediate glove layer is positioned between the first and second discrete parts prior to connection of the first and second discrete parts. In one embodiment, each securement tab is welded (e.g. fused) to the first and second discrete parts. In this way the securement tabs are connected to their respective ones of the first plurality of fingers during the step of connecting the first and second discrete parts.

In one embodiment, the oversized glove former is alterable between an expanded configuration and a contracted configuration (e.g. for assisting placement of the inner and intermediate glove layers over the oversized glove former and subsequent removal of the intermediate glove part from the oversized glove former), and the method further comprises placing at least one of the inner glove layer and the intermediate glove layer over the oversized glove former whilst the oversized glove former is in the contracted configuration.

In one embodiment, the step of adhering the inner glove layer to the intermediate glove layer is carried out whilst the inner glove layer and intermediate glove layer are in position over the oversized glove former in the expanded configuration.

In one embodiment, the oversized glove former comprises a main hand portion and thumb portion movable (e.g. pivotable) relative to the main hand portion between a laterally extended position (e.g. with the thumb portion extending away from the main hand portion) when the oversized glove former is in the expanded configuration and a folded position (e.g. with the thumb portion positioned adjacent or beneath the main hand portion) when the oversized glove former is in the contracted configuration.

In one embodiment, the step of adhering the inner glove layer to the intermediate glove layer is carried out while the inner glove layer is stretched over the intermediate glove layer.

In one embodiment, the step of adhering the inner glove layer to the intermediate glove layer is carried out while the inner and intermediate glove layers are positioned over the oversized glove former.

In one embodiment, the step of adhering the intermediate glove layer to the inner glove layer comprises applying heat.

In one embodiment, the step of adhering the intermediate glove layer to the inner glove layer comprises applying pressure.

In one embodiment, the intermediate glove layer comprises a hydrophilic polyurethane membrane or microporous hydrophobic polyurethane membrane of types known in the art.

In one embodiment, the intermediate glove layer comprises a flexible film (e.g. 10-80 microns thick).

In one embodiment, the intermediate glove layer is substantially inelastic.

In one embodiment, the inner glove layer is elastic.

In one embodiment, the inner glove layer is water-permeable.

In one embodiment, the inner glove layer is a knitted glove layer (e.g. warp knitted glove layer) or woven glove layer.

In one embodiment, the inner and outer glove layers and the intermediate glove layer all have a profile corresponding to a predetermined profile of the glove (e.g. with each layer defining an opening for receiving a user's hand).

In one embodiment, the inner glove layer consists of a single seamless part (e.g. single knitted or woven part).

In one embodiment, the intermediate glove layer is formed by connecting a plurality of discrete parts (e.g. with the discrete parts being welded together to form a glove layer that is resistant to penetration by liquid water). In one embodiment, the plurality of discrete parts comprise front and rear parts.

In one embodiment, the plurality of discrete parts are connected together prior to the step of providing the intermediate glove layer adjacent to the inner glove layer (e.g. the intermediate glove layer is pre-formed).

In one embodiment, the outer glove layer is substantially non-stretchable (e.g. a leather or imitation leather layer, or non-stretchable fabric layer).

In one embodiment, the outer glove layer comprises a plurality of panels (e.g. stitched together before or after attachment to the intermediate glove part).

In one embodiment, the step of adhering the inner glove layer to the intermediate glove layer comprises activating adhesive provided to adhere between the inner glove layer and the intermediate glove layer. In one embodiment, the adhesive is heat activated.

In one embodiment, the adhesive is provided as an adhesive layer between the inner glove layer and the intermediate glove layer.

In one embodiment, the adhesive provided between the inner glove layer and the intermediate glove layer (e.g. adhesive layer) is formed as a discontinuous pattern of adhesive.

In one embodiment, the adhesive is carried by the intermediate glove layer. For example, the adhesive layer may be applied to the inner surface of the intermediate glove layer (e.g. before or after connecting discrete parts of the intermediate glove layer together).

In one embodiment, the adhesive provided between the inner glove layer and the intermediate glove layer is applied to the intermediate glove layer before covering the inner glove layer with the intermediate glove layer.

In accordance with a second aspect of the present invention, there is provided a method of manufacturing a component part of a breathable waterproof glove, the method comprising: providing an inner glove layer in a stretched configuration over an oversized glove former; and while the inner glove layer is in the stretched configuration adhering the inner glove layer to an inner surface of an intermediate glove layer resistant to penetration by liquid water but permeable to water vapour at a plurality of discrete securement locations (e.g. to form a discontinuous pattern of securement locations between the inner glove layer and the intermediate glove layer to enable folding of the intermediate glove layer relative to the inner glove layer) to form an intermediate glove part in a stretched configuration, the intermediate glove layer defining a first plurality of finger portions; wherein the method further comprises the step of attaching to each one of the first plurality of finger portions a respective securement tab for use in connecting each one of the first plurality of finger portions to a respective one of a second plurality of finger portions formed on an outer glove layer.

In one embodiment, following attachment of the intermediate glove layer to the inner glove layer, the inner glove layer is stretchable by at least 5% in at least one direction (for example by at least 10% in at least one direction, at least 20% in at least one direction or at least 30% in at least one direction).

In one embodiment the method comprises forming the inner glove layer in a stretched configuration over the oversized glove former and while the inner glove layer is in the stretched configuration providing the intermediate glove layer adjacent the inner glove layer (e.g. over the inner glove layer).

In one embodiment, the securement tabs are formed from an elastic material (e.g. an elastic fabric, such as an elastic woven fabric or elastic fabric tape).

In a first arrangement, each securement tab is connected at a first end to its respective one of the first plurality of finger portions by an adhesive connection.

In a second arrangement, each securement tab is connected to its respective one of the first plurality of fingers at first and second mutually spaced locations to form a loop.

In one embodiment, the loop formed by each securement tab comprises a central part (e.g. located between the first and second mutually spaced locations) configured for attaching each securement tab to a respective one of a second plurality of finger portions formed on an outer glove layer. In one embodiment, the central part of the loop is spaced from its respective one of the first plurality of fingers (e.g. separated from its respective one of the first plurality of fingers by an opening).

In one embodiment, the first and second mutually spaced locations are on opposed sides each of the first plurality of fingers (e.g. opposed front and rear sides or opposed lateral sides).

In one embodiment, each securement tab is connected to its respective one of the first plurality of fingers at the first and second mutually spaced locations by first and second adhesive connections respectively.

In both the first and second arrangements, the step of attaching the securement tabs to each of the first plurality of finger portions may comprise attaching the securement tabs to each of the first plurality of finger portions during the step of adhering the inner glove layer to the inner surface of the intermediate glove layer. For example, the attachment step may comprise a two-stage process with a first stage in which a degree of attachment occurs prior to the step of adhering the inner glove layer to the intermediate glove layer and a second stage in which full attachment occurs during the step of adhering the inner glove layer to the intermediate glove layer (e.g. by activating an adhesive (e.g. heat activated adhesive) provided between the securement tabs and the intermediate glove layer).

In a third arrangement, each securement tab extends through the intermediate glove layer (e.g. through its respective one of the first plurality of fingers).

In one embodiment, each securement tab is connected at a first end to the inner glove layer (e.g. to a respective one of a third plurality of finger portions formed on the inner glove layer in registration with the finger portions of the first plurality)(e.g. by a sewn connection).

In one embodiment, each securement tab is configured to be connected at a second end (e.g. opposite to the first end) to its respective one of the second plurality of finger portions (e.g. by a sewn connection).

In one embodiment, the intermediate glove layer is formed by connecting a plurality of discrete parts (e.g. with the discrete parts being welded together (e.g. radio frequency, ultrasonic or hot-bar welded) to form a glove layer that is resistant to penetration by liquid water) and each securement tab extending through the intermediate glove layer is connected to the intermediate glove layer during connection of the plurality of discrete parts. For example, the first plurality of fingers may be formed by connecting first and second discrete parts (e.g. front and rear parts of the intermediate glove layer defining respectively front and rear sections of the third plurality of fingers portions) and each securement tab extending through the intermediate glove layer is positioned between the first and second discrete parts prior to connection of the first and second discrete parts. In one embodiment, each securement tab is welded (e.g. fused) to the first and second discrete parts. In this way the securement tabs are connected to their respective ones of the first plurality of fingers during the step of connecting the first and second discrete parts.

In one embodiment, the oversized glove former is alterable between an expanded configuration and a contracted configuration (e.g. for assisting placement of the inner and intermediate glove layers over the oversized glove former and subsequent removal of the intermediate glove part from the oversized glove former), and the method further comprises placing at least one of the inner glove layer and the intermediate glove layer over the oversized glove former whilst the oversized glove former is in the contracted configuration.

In one embodiment, the step of adhering the inner glove layer to the intermediate glove layer is carried out whilst the inner glove layer and intermediate glove layer are in position over the oversized glove former in the expanded configuration.

In one embodiment, the oversized glove former comprises a main hand portion and thumb portion movable (e.g. pivotable) relative to the main hand portion between a laterally extended position (e.g. with the thumb portion extending away from the main hand portion) when the oversized glove former is in the expanded configuration and a folded position (e.g. with the thumb portion positioned adjacent or beneath the main hand portion) when the oversized glove former is in the contracted configuration.

In one embodiment, the step of adhering the inner glove layer to the intermediate glove layer is carried out while the inner glove layer is stretched over the intermediate glove layer.

In one embodiment, the step of adhering the inner glove layer to the intermediate glove layer is carried out while the inner and intermediate glove layers are on the oversized glove former.

In one embodiment, the step of adhering the intermediate glove layer to the inner glove layer comprises applying heat.

In one embodiment, the step of adhering the intermediate glove layer to the inner glove layer comprises applying pressure.

In one embodiment, the intermediate glove layer comprises a hydrophilic polyurethane membrane or microporous hydrophobic polyurethane membrane of types known in the art.

In one embodiment, the intermediate glove layer comprises a flexible film (e.g. 10-80 microns thick).

In one embodiment, the intermediate glove layer is substantially inelastic.

In one embodiment, the inner glove layer is elastic.

In one embodiment, at least one of (e.g. both) of the inner and outer glove layers is water-permeable.

In one embodiment, the inner glove layer is a knitted glove layer (e.g. warp knitted glove layer) or woven glove layer.

In one embodiment, the inner glove layer and intermediate glove layer each have a profile corresponding to a predetermined profile of the glove (e.g. with each layer defining an opening for receiving a user's hand).

In one embodiment, the inner glove layer consists of a single seamless part (e.g. single knitted or woven part).

In one embodiment, the intermediate glove layer is formed by connecting a plurality of discrete parts (e.g. with the discrete parts being welded together to form a glove layer that is resistant to penetration by liquid water). In one embodiment, the plurality of discrete parts comprise front and rear parts.

In one embodiment, the plurality of discrete parts are connected together prior to the step of providing the intermediate glove layer adjacent to the inner glove layer (e.g. the intermediate glove layer is pre-formed).

In one embodiment, the step of adhering the inner glove layer to the intermediate glove layer comprises activating adhesive provided to adhere between the inner glove layer and the intermediate glove layer. In one embodiment, the adhesive is heat activated.

In one embodiment, the adhesive is provided as an adhesive layer between the inner glove layer and the intermediate glove layer.

In one embodiment, the adhesive provided between the inner glove layer and the intermediate glove layer (e.g. adhesive layer) is formed as a discontinuous pattern of adhesive.

In one embodiment, the adhesive is carried by the intermediate glove layer. For example, the adhesive layer may be applied to the inner surface of the intermediate glove layer (e.g. before or after connecting discrete parts of the intermediate glove layer together).

In one embodiment, the adhesive provided between the inner glove layer and the intermediate glove layer is applied to the intermediate glove layer before covering the inner glove layer with the intermediate glove layer.

In accordance with a third aspect of the present invention, there is provided a method of manufacturing a breathable waterproof glove, the method comprising: providing a component part of a breathable waterproof glove, the component part comprising: an intermediate glove part defining a first plurality of finger portions, the intermediate glove part comprising: an inner glove layer; and an intermediate glove layer provided in a folded configuration (e.g. corrugated, ruched or puckered configuration) adjacent the inner glove layer, the intermediate glove layer being resistant to penetration by liquid water but permeable to water vapour, the intermediate glove layer defining a first plurality of finger portions and being attached to the inner glove layer by regions of adhesive provided at a plurality of discrete securement locations; and a plurality of securement tabs, each securement tab being attached to a respective one of the plurality of finger portions; and attaching each one of the first plurality of finger portions to a corresponding one of a second plurality of finger portions formed on an outer glove layer by connecting the securement tab associated with each one of the first plurality of finger portions to a respective one of the second plurality of finger portions.

In one embodiment, intermediate glove part is stretchable by at least 5% in at least one direction (for example by at least 10% in at least one direction, at least 20% in at least one direction or at least 30% in at least one direction).

In one embodiment, the securement tabs are formed from an elastic material (e.g. an elastic fabric, such as an elastic woven fabric or elastic fabric tape).

In one embodiment, the step of attaching the outer glove layer to the intermediate glove part is performed whilst the intermediate glove is in a relaxed configuration (e.g. after removal from the oversized glove former).

In a first arrangement, each securement tab is connected at a first end to its respective one of the first plurality of finger portions by an adhesive connection.

In one embodiment, each securement tab is connected at a second end (e.g. opposite to the first end) to its respective one of the second plurality of finger portions by a sewn connection.

In a second arrangement, each securement tab is connected to its respective one of the first plurality of fingers at first and second mutually spaced locations to form a loop.

In one embodiment, each securement tab is connected at a central part of the loop (e.g. between the first and second mutually spaced locations) to its respective one of the second plurality of finger portions (e.g. by a sewn connection). In one embodiment, the central part of the loop is spaced from its respective one of the first plurality of fingers (e.g. separated from its respective one of the first plurality of fingers by an opening).

In one embodiment, the first and second mutually spaced locations are on opposed sides each of the first plurality of fingers (e.g. opposed front and rear sides or opposed lateral sides).

In one embodiment, each securement tab is connected to its respective one of the first plurality of fingers at the first and second mutually spaced locations by first and second adhesive connections respectively.

In a third arrangement, each securement tab extends through the intermediate glove layer (e.g. through its respective one of the first plurality of fingers).

In one embodiment, each securement tab is connected at a first end to the inner glove layer (e.g. to a respective one of a third plurality of finger portions formed on the inner glove layer in registration with the finger portions of the first plurality)(e.g. by a sewn connection).

In one embodiment, each securement tab is connected at a second end (e.g. opposite to the first end) to its respective one of the second plurality of finger portions (e.g. by a sewn connection).

In one embodiment, each securement tab extends between first and second discrete parts (e.g. front and rear parts of the intermediate glove layer defining respectively front and rear sections of the third plurality of fingers portions) forming the intermediate glove layer.

In one embodiment, each securement tab is welded (e.g. fused) to the first and second discrete parts.

In one embodiment, the intermediate glove layer comprises a hydrophilic polyurethane membrane or microporous hydrophobic polyurethane membrane of types known in the art.

In one embodiment, the intermediate glove layer comprises a flexible film (e.g. 10-80 microns thick).

In one embodiment, the intermediate glove layer is substantially inelastic.

In one embodiment, the inner glove layer is elastic.

In one embodiment, at least one of (e.g. both) of the inner and outer glove layers is water-permeable.

In one embodiment, the inner glove layer is a knitted glove layer (e.g. warp knitted glove layer) or woven glove layer.

In one embodiment, the inner and outer glove layers and the intermediate glove layer all have a profile corresponding to a predetermined profile of the glove (e.g. with each layer defining an opening for receiving a user's hand).

In one embodiment, the inner glove layer consists of a single seamless part (e.g. single knitted or woven part).

In one embodiment, the intermediate glove layer is formed by connecting a plurality of discrete parts (e.g. with the discrete parts being welded together to form a glove layer that is resistant to penetration by liquid water). In one embodiment, the plurality of discrete parts comprise front and rear parts.

In one embodiment, the plurality of discrete parts are connected together prior to the step of providing the intermediate glove layer adjacent to the inner glove layer (e.g. the intermediate glove layer is pre-formed).

In one embodiment, the outer glove layer is substantially non-stretchable (e.g. a leather or imitation leather layer, or non-stretchable fabric layer).

In one embodiment, the outer glove layer comprises a plurality of panels (e.g. stitched together before or after attachment to the intermediate glove part).

In one embodiment, adhesive is provided between the inner glove layer and the intermediate glove layer (e.g. adhesive layer) is formed as a discontinuous pattern of adhesive.

In accordance with a fourth aspect of the present invention, there is provided a breathable waterproof glove comprising: an inner glove layer; an outer glove layer; and an intermediate glove layer provided in a folded configuration (e.g. corrugated, ruched or puckered configuration) between the inner and outer glove layers, the intermediate glove layer being resistant to penetration by liquid water but permeable to water vapour; wherein: the intermediate glove layer is attached to the inner glove layer by regions of adhesive provided at a plurality of discrete securement locations (e.g. forming a discontinuous pattern of securement locations between the inner glove layer and the intermediate glove layer to enable folding of the intermediate glove layer relative to the inner glove layer); and the intermediate glove part and outer glove part define a first and second plurality of finger portions respectively, with each one of the first plurality of finger portions being attached to a respective one of the second plurality of finger portions by a respective interconnecting securement tab.

In one embodiment, the securement tabs are formed from an elastic material (e.g. an elastic fabric, such as an elastic woven fabric or elastic fabric tape).

In a first arrangement, each securement tab is connected at a first end to its respective one of the first plurality of finger portions by an adhesive connection.

In one embodiment, each securement tab is connected at a second end (e.g. opposite to the first end) to its respective one of the second plurality of finger portions by a sewn connection.

In a second arrangement, each securement tab is connected to its respective one of the first plurality of fingers at first and second mutually spaced locations to form a loop.

In one embodiment, each securement tab is connected at a central part of the loop (e.g. between the first and second mutually spaced locations) to its respective one of the second plurality of finger portions (e.g. by a sewn connection). In one embodiment, the central part of the loop is spaced from its respective one of the first plurality of fingers (e.g. separated from its respective one of the first plurality of fingers by an opening).

In one embodiment, the first and second mutually spaced locations are on opposed sides each of the first plurality of fingers (e.g. opposed front and rear sides or opposed lateral sides).

In one embodiment, each securement tab is connected to its respective one of the first plurality of fingers at the first and second mutually spaced locations by first and second adhesive connections respectively.

In a third arrangement, each securement tab extends through the intermediate glove layer (e.g. through its respective one of the first plurality of fingers).

In one embodiment, each securement tab is connected at a first end to the inner glove layer (e.g. to a respective one of a third plurality of finger portions formed on the inner glove layer in registration with the finger portions of the first plurality)(e.g. by a sewn connection).

In one embodiment, each securement tab is connected at a second end (e.g. opposite to the first end) to its respective one of the second plurality of finger portions (e.g. by a sewn connection).

In one embodiment, each securement tab extends between first and second discrete parts (e.g. front and rear parts of the intermediate glove layer defining respectively front and rear sections of the third plurality of fingers portions) forming the intermediate glove layer.

In one embodiment, each securement tab is welded (e.g. fused) to the first and second discrete parts.

In one embodiment, the outer glove layer is substantially non-stretchable (e.g. a leather or imitation leather layer, or non-stretchable fabric layer).

In one embodiment, the outer glove layer comprises a plurality of panels (e.g. stitched together before or after attachment to the intermediate glove part).

In one embodiment, the intermediate glove layer comprises a hydrophilic polyurethane membrane or microporous hydrophobic polyurethane membrane.

In one embodiment, the intermediate glove layer comprises a flexible film (e.g. 10-80 microns thick).

In one embodiment, the folded configuration of the intermediate glove layer is configured to allow stretching of the glove by at least 5% in at least one direction (e.g. by at least 10% in at least one direction, by at least 20% in at least one direction or by at least 30% in at least one direction).

In one embodiment, the intermediate glove layer is substantially inelastic.

In one embodiment, the inner glove layers is elastic.

In one embodiment, at least one of (e.g. both) of the inner and outer glove layers is water-permeable.

In one embodiment, the inner glove layer is a knitted glove layer (e.g. warp knitted glove layer) or woven glove layer.

In one embodiment, the inner and outer glove layers and the intermediate glove layer all have a profile corresponding to a predetermined profile of the glove (e.g. with each layer defining an opening for receiving a user's hand).

In one embodiment, the inner glove layer consists of a single seamless part (e.g. single knitted or woven part).

In accordance with a fifth aspect of the present invention, there is provided a component part for forming a breathable waterproof glove, the component part comprising: an intermediate glove part an intermediate glove part defining a first plurality of finger portions, the intermediate glove part comprising: an inner glove layer; and intermediate glove layer provided in a folded configuration (e.g. corrugated, ruched or puckered configuration) adjacent the inner glove layer, the intermediate glove layer being resistant to penetration by liquid water but permeable to water vapour; wherein the intermediate glove layer is attached to the inner glove layer by regions of adhesive provided at a plurality of discrete securement locations (e.g. forming a discontinuous pattern of securement locations between the inner glove layer and the intermediate glove layer to enable folding of the intermediate glove layer relative to the inner glove layer); wherein the intermediate glove part defines a plurality of finger portions each having attached thereto a securement tab for connecting the intermediate glove part to an outer glove part (e.g. finger portion of an outer glove part).

In one embodiment, the securement tabs are formed from an elastic material (e.g. an elastic fabric, such an elastic woven fabric or elastic fabric tape).

In a first arrangement, each securement tab is connected at a first end to its respective one of the first plurality of finger portions by an adhesive connection.

In a second arrangement, each securement tab is connected to its respective one of the plurality of fingers at first and second mutually spaced locations to form a loop.

In one embodiment, the loop formed by each securement tab comprises a central part (e.g. located between the first and second mutually spaced locations) configured for attaching each securement tab to an outer glove layer (e.g. finger portion of an outer glove layer). In one embodiment, the central part of the loop is spaced from its respective one of the plurality of fingers (e.g. separated from its respective one of the plurality of fingers by an opening).

In one embodiment, the first and second mutually spaced locations are on opposed sides each of the plurality of fingers (e.g. opposed front and rear sides or opposed lateral sides).

In one embodiment, each securement tab is connected to its respective one of the plurality of fingers at the first and second mutually spaced locations by first and second adhesive connections respectively.

In a third arrangement, each securement tab extends through the intermediate glove layer (e.g. through its respective one of the plurality of fingers).

In one embodiment, each securement tab is connected at a first end to the inner glove layer (e.g. to a respective one of a further plurality of finger portions formed on the inner glove layer in registration with the first-defined plurality of finger portions)(e.g. by a sewn connection).

In one embodiment, each securement tab is configured to be connected at a second end (e.g. opposite to the first end) to respective finger portions of an outer glove part (e.g. by a sewn connection).

In one embodiment, each securement tab extends between first and second discrete parts (e.g. front and rear parts of the intermediate glove layer defining respectively front and rear sections of the further-defined plurality of fingers portions) forming the intermediate glove layer.

In one embodiment, each securement tab is welded (e.g. fused) to the first and second discrete parts.

In one embodiment, the intermediate glove layer comprises a hydrophilic polyurethane membrane or microporous hydrophobic polyurethane membrane.

In one embodiment, the intermediate glove layer comprises a flexible film (e.g. 10-80 microns thick).

In one embodiment, the folded configuration of the intermediate glove layer is configured to allow stretching of the glove by at least 5% in at least one direction (e.g. by at least 10% in at least one direction, by at least 20% in at least one direction or by at least 30% in at least one direction).

In one embodiment, the intermediate glove layer is substantially inelastic.

In one embodiment, the inner glove layers is elastic.

In one embodiment, the inner glove layer is water-permeable.

In one embodiment, the inner glove layer is a knitted glove layer (e.g. warp knitted glove layer) or woven glove layer.

In one embodiment, the inner glove layer and the intermediate glove layer each have a profile corresponding to a predetermined profile of the glove (e.g. with each layer defining an opening for receiving a user's hand).

In one embodiment, the inner glove layer consists of a single seamless part (e.g. single knitted or woven part).

In accordance with a sixth aspect of the present invention, there is provided a method of manufacturing a breathable waterproof glove, the method comprising: forming a first glove layer in a stretched configuration over an oversized glove former; covering the first glove layer with an intermediate glove layer resistant to penetration by liquid water but permeable to water vapour; covering the intermediate glove layer with a second glove layer; and while the first and second glove layers are simultaneously stretched over the oversized glove former adhering the intermediate glove layer to both the first and second glove layers at a plurality of discrete securement locations (e.g. to form a discontinuous pattern of securement locations between each of the first and second glove layers and the intermediate glove layer to enable folding of the intermediate glove layer relative to the first and second glove layers).

In this way, a 1-stage adhesive application process for the manufacture of a waterproof breathable (and windproof) glove is provided in which the glove includes an intermediate glove layer that is waterproof (e.g. resistant to penetration by liquid water under normal conditions during wear) but breathable and allows significant stretching of the first and second glove layers (e.g. by at least 5% in at least one direction, for example by at least 10% in at least one direction, at least 20% in at least one direction or at least 30% in at least one direction).

In one embodiment, one or both of the steps of covering the first glove layer with the intermediate glove layer and covering the intermediate glove layer with the second glove layer occur before the first glove layer is formed into the stretched configuration over the oversized glove former.

In one embodiment, the oversized glove former is alterable between an expanded configuration and a contracted configuration (e.g. for assisting placement the glove layers over the oversized glove former and subsequent removal of the glove from the oversized glove former), and the method further comprises placing at least one of the first, intermediate and second glove layers over the oversized glove former whilst the oversized glove former is in the contracted configuration.

In one embodiment, the step of adhering the first and second glove layers to the intermediate glove layer is carried out whilst the oversized glove former is in the expanded configuration.

In one embodiment, the oversized glove former comprises a main hand portion and thumb portion movable (e.g. pivotable) relative to the main hand portion between a laterally extended position (e.g. with the thumb portion extending away from the main hand portion) when the oversized glove former is in the expanded configuration and a folded position (e.g. with the thumb portion positioned adjacent or beneath the main hand portion) when the oversized glove former is in the contracted configuration.

In one embodiment, the step of adhering the intermediate glove layer to both the first and second glove layers occurs substantially simultaneously.

In one embodiment, the step of adhering the intermediate glove layer to both the first and second glove layers comprises applying heat.

In one embodiment, the step of adhering the intermediate glove layer to both the first and second glove layers comprises applying pressure.

In one embodiment, the intermediate glove layer comprises a hydrophilic polyurethane membrane or microporous hydrophobic polyurethane membrane of types well known in the art.

In one embodiment, the intermediate glove layer comprises a flexible film (e.g. 10-80 microns thick).

In one embodiment, the intermediate glove layer is substantially inelastic. In one embodiment, the first glove layer forms an inner layer of the glove and the second glove layer forms an outer layer of the glove. Advantageously, forming the outer glove layer onto the oversized glove former first protects the (typically softer) inner glove layer from damage resulting from contact with the oversized glove former during manufacture and may further act to prevent damage to the intermediate glove layer.

In one embodiment, at least one (e.g. both) of the first and second glove layers is elastic.

In one embodiment, at least one (e.g. both) of the first and second glove layers is water-permeable.

In one embodiment, at least one (e.g. both) of the first and second glove layers is a knitted glove layer (e.g. warp knitted glove layer) or woven glove layer.

In one embodiment, the first and second glove layers and the intermediate glove layer all have a profile corresponding to a predetermined profile of the glove (e.g. with each layer defining an opening for receiving a user's hand).

In one embodiment, at least one (e.g. both) of the first and second glove layers each consist of a single seamless part (e.g. single knitted or woven part).

In one embodiment, the intermediate glove layer is formed by connecting a plurality of discrete parts (e.g. with the discrete parts being welded together to form a glove layer that is resistant to penetration by liquid water). In one embodiment, the plurality of discrete parts comprise front and rear parts.

In one embodiment, the plurality of discrete parts are connected together prior to the step of covering the first glove layer with the intermediate glove layer (e.g. the intermediate glove layer is pre-formed).

In one embodiment, the step of adhering the first glove layer to the intermediate glove layer comprises activating adhesive provided to adhere between the first glove layer and the intermediate glove layer. In one embodiment, the adhesive is heat activated.

In one embodiment, the adhesive is provided as a first adhesive layer between the first glove layer and the intermediate glove layer.

In one embodiment, the adhesive provided between the first glove layer and the intermediate glove layer (e.g. first adhesive layer) is formed as a discontinuous pattern of adhesive.

In one embodiment, the adhesive is carried by the intermediate glove layer. For example, the first adhesive layer may be applied to the first surface of the intermediate glove layer (e.g. before or after connecting discrete parts of the intermediate glove layer together).

In one embodiment, the step of adhering the second glove layer to the intermediate glove layer comprises activating adhesive provided to adhere between the second glove layer and the intermediate glove layer. In one embodiment, the adhesive is heat activated.

In one embodiment, the adhesive is provided as a second adhesive layer between the second glove layer and the intermediate glove layer.

In one embodiment, the adhesive provided between the second glove layer and the intermediate glove layer (e.g. second adhesive layer) is formed as a discontinuous pattern of adhesive.

In one embodiment, discontinuous patterns of adhesive provided between the first glove layer and the intermediate glove layer (e.g. first adhesive layer) and between the second glove layer and intermediate glove layer (e.g. second adhesive layer) are substantially similar in terms of area of coverage.

In one embodiment, the adhesive is carried by the intermediate glove layer. For example, the second adhesive layer may be applied to the second surface of the intermediate glove layer (e.g. before or after connecting discrete parts of the intermediate glove layer together).

In one embodiment, the adhesive provided between the second glove layer and the intermediate glove layer is applied to the intermediate glove layer before covering the first glove layer with the intermediate glove layer.

In one embodiment, the method further comprises subsequent to adhering the first and second glove layers to the intermediate glove layer, removing the glove from the oversized glove former and with the inner glove layer outermost filling the glove with water to wet the outer glove layer prior to shrinking the glove. In this way, water is simultaneously applied as part of a shrinking step and a leak testing step. Where the first glove layer forms an inner layer of the glove and the second glove layer forms an outer layer of the glove, the glove will already be in the correct orientation to carry out this step (i.e. there is no need for an additional step of inverting the glove). Typically the inner glove layer is not wet during this or any subsequent step.

In accordance with a seventh aspect of the present invention, there is provided a breathable waterproof glove comprising: an inner glove layer; an outer glove layer; and an intermediate glove layer provided in a folded configuration (e.g. corrugated, ruched or puckered configuration) between the inner and outer glove layers, the intermediate glove layer being resistant to penetration by liquid water but permeable to water vapour; wherein the intermediate glove layer is attached to both the inner glove layer and the outer glove layer by regions of adhesive provided at a plurality of discrete securement locations.

In one embodiment, the intermediate glove layer comprises a hydrophilic polyurethane membrane or microporous hydrophobic polyurethane membrane.

In one embodiment, the intermediate glove layer comprises a flexible film (e.g. 10-80 microns thick).

In one embodiment, the folded configuration of the intermediate glove layer is configured to allow stretching of the glove by at least 5% in at least one direction (e.g. by at least 10% in at least one direction, by at least 20% in at least one direction or by at least 30% in at least one direction).

In one embodiment, the intermediate glove layer is substantially inelastic. In one embodiment, at least one (e.g. both) of the inner and outer glove layers is elastic.

In one embodiment, at least one (e.g. both) of the inner and outer glove layers is water-permeable.

In one embodiment, at least one (e.g. both) of the inner and outer glove layers is a knitted glove layer (e.g. warp knitted glove layer) or woven glove layer.

In one embodiment, the inner and outer glove layers and the intermediate glove layer all have a profile corresponding to a predetermined profile of the glove.

In one embodiment, at least one (e.g. both) of the inner and outer glove layers each consist of a single seamless part (e.g. single knitted or woven part).

Embodiments of the present invention will now be described by way of example with reference to the accompanying drawings in which:

FIGS. 1-5 illustrate a method of manufacturing a novel three-layer waterproof windproof breathable glove 10.

Figure 1:
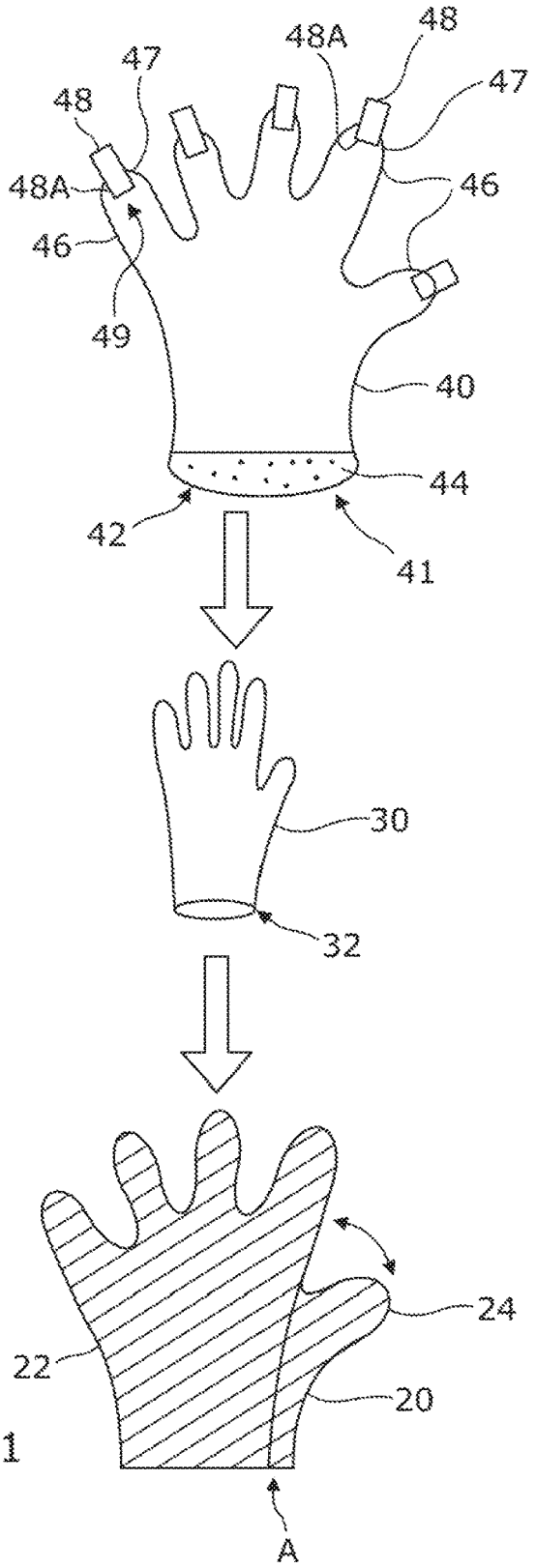
FIG. 1 is a schematic illustration of components of a novel component glove part for forming a breathable waterproof glove being sequentially inserted over an oversized glove former in accordance with an embodiment of the method of the present invention.

As shown in FIG. 1, a first stage of the method comprises sequentially forming two layers of component glove part 50 on a planar oversized glove former 20 comprising a main hand portion 22 and a hinged thumb portion 24 pivotable relative to the main hand portion 22 about a pivot axis "A" between a laterally extended position (as shown) in which thumb portion 24 extends away from main hand portion 22 and a folded position in which with thumb portion 24 is positioned beneath main hand portion 22. In the illustrated embodiment, oversized glove former 20 is at least 30% larger than eventual glove 10 in both planar dimensions.

In step one, an elastic, stretchable water permeable knitted inner glove layer 30 having approximately the same profile as the eventual glove 10 (including an opening 32 for receiving a user's hand) is stretched over the oversized glove former 20, the hinged thumb portion 24 is retracted inwards into the folded position to allow inner glove layer 30 to be stretched over oversized glove former 20 without causing damage to the knit, or localised overstretching of the inner glove layer 30. Inner glove layer 30 may be formed from a single continuous (e.g. seamless) warp knitted layer and will typically configured to wick moisture away from the wearer.

In step two, a flexible intermediate glove layer 40 of limited stretchability relative to the inner glove layer 30 and having approximately the same profile (including an opening 42 for receiving a user's hand) as oversized glove former 20 is drawn over inner glove layer 30, again with hinged thumb portion 24 in the folded position to allow intermediate glove layer 40 to be placed over inner glove layer 30 without damaging intermediate glove layer 40 which is a snug fit around oversized glove former 20 when the hinged thumb portion 24 is in the extended position. Intermediate glove layer 40 comprises an inelastic membrane (typically 30-40 microns thick) resistant to penetration by liquid water but permeable to water vapour perspiration (e.g. a hydrophilic polyurethane membrane or microporous hydrophobic polyurethane membrane of types known in the art). Intermediate glove layer 40 includes an inner layer 42 on which is printed a discontinuous pattern (e.g. dots, a network, lines or a combination thereof) of water based co-polyamide heat activatable adhesive, or other types of adhesive known in the art (e.g. powder coat or hot-melt types) 44. The membrane may be formed from a plurality of shaped membrane sheets welded together (e.g. radio frequency, ultrasonic or hot-bar welded). An outer perimeter of intermediate glove layer 40 is additionally welded to form a watertight seal. Intermediate glove layer 40 also defines a first plurality of finger portions 46 each including tip portion 47 having one end 48A of an elastic fabric securement tab 48 attached thereto by a heat activated adhesive regions 49.

Figure 2:
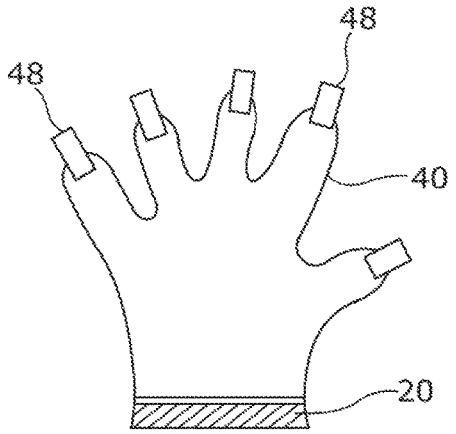
FIG. 2 shows the components of the novel component glove part of FIG. 1 assembled in position over the oversized glove former.

In step three, thumb portion 24 of oversized glove former 20 is pivoted back into the extended position to form the arrangement shown in FIG. 2 with the two glove layers 30, 40 mounted sequentially on oversized glove former 20. Oversized glove former 20 with the two glove layers 30, 40 mounted thereon is then passed through a laminating machine 60 in which discontinuous patterns of heat activatable adhesive 44 and heat activated adhesive regions 49 are activated by heat. Pressure is than applied by one or more rollers 62 to squeeze the softened adhesive into the knit of the fabric of the inner glove layer 30 and into securement tabs 48.

Figure 4:
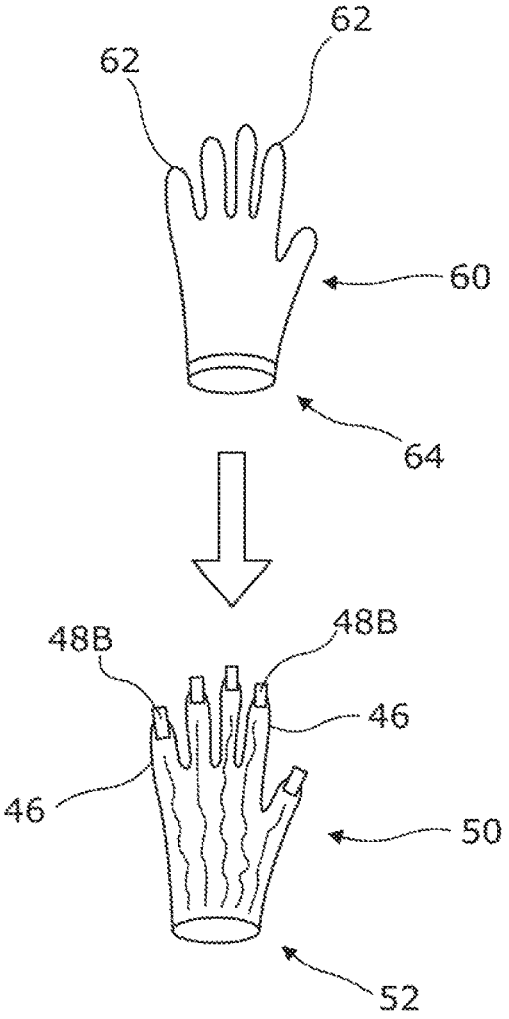
FIG. 4 is a schematic illustration of the novel component glove part being attached to an outer glove part.

After lamination, in step four thumb portion 24 of oversized glove former 20 is pivoted to the folded position to enable the resulting article to be removed from oversized glove former 20, at which point the inner glove layer 30 will retract slightly by the pulling in of the fabric knit. Once the article has cooled, it is then put through a shrinking process including the steps of wetting inner glove layer 30 with water, removing some of the moisture mechanically and then exposing the article to heat (e.g. in a tumble dryer) to form component glove part 50 as shown in FIG. 4. After a predetermined period of drying, component glove part 50 is removed from the heat, with the shrinking of the inner glove layer 30 resulting in folding of the inelastic intermediate glove layer 40 and also closed the knit of the inner glove layer 30 to its original knitted shape. Inner glove layers 30 can now be stretched back to its pre-laminated stretched configuration without applying any stress to intermediate glove layer 40.

In step five, a component glove part 50 is attached to an outer glove layer 60 (including an opening 64 for receiving a user's hand) by sewing a second end 48B of each of securement tabs 48 attached to component glove part 50 to corresponding second finger portions 62 of outer glove layer 60 to form the final glove 10. Outer glove layer 60 may be formed from a variety of materials (including materials that have limited stretchability) and may be formed from a plurality of panels (e.g. a "cut and sewn" outer glove layer).

Figure 3:
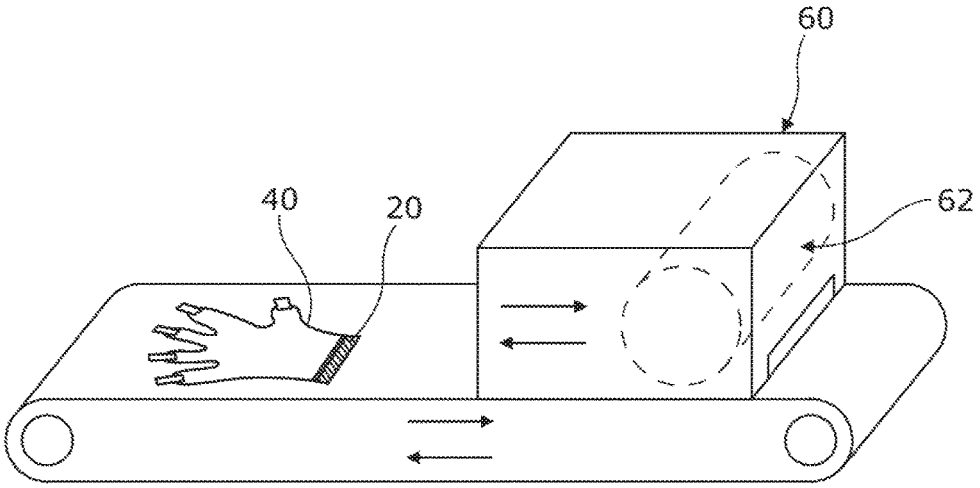
FIG. 3 is a schematic illustration of a laminating step in accordance with an embodiment of the method of the present invention.

FIGS. 6-8A/B show a method for sequentially forming two layers of a component glove part 50' according to a second embodiment of the present invention based on the method of FIGS. 1-3 (features in common with the first embodiment are labelled accordingly). Component glove part 50' differs from component glove part 50 in that each elastic fabric securement tab 48' has first and second ends 48A', 48B' connected to front and rear heat activated adhesive regions 49A, 49B of its respective tip portion 47' to form a loop 48C (as most clearly illustrated in FIG. 8A). As loop 48C is connected to tip portion 47' at two opposed locations, the tendency for elastic fabric securement tab 48' to damage or pull away from intermediate glove layer 40' is advantageously reduced.

Figure 5:
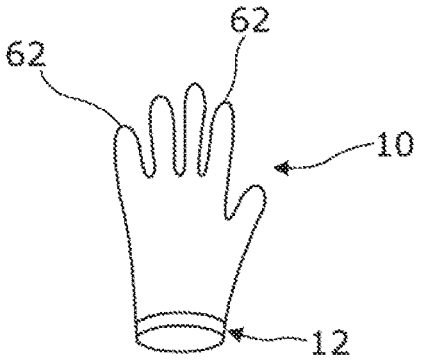
FIG. 5 shows the final novel product formed following the steps illustrated in FIGS. 1-4.
Figure 6:
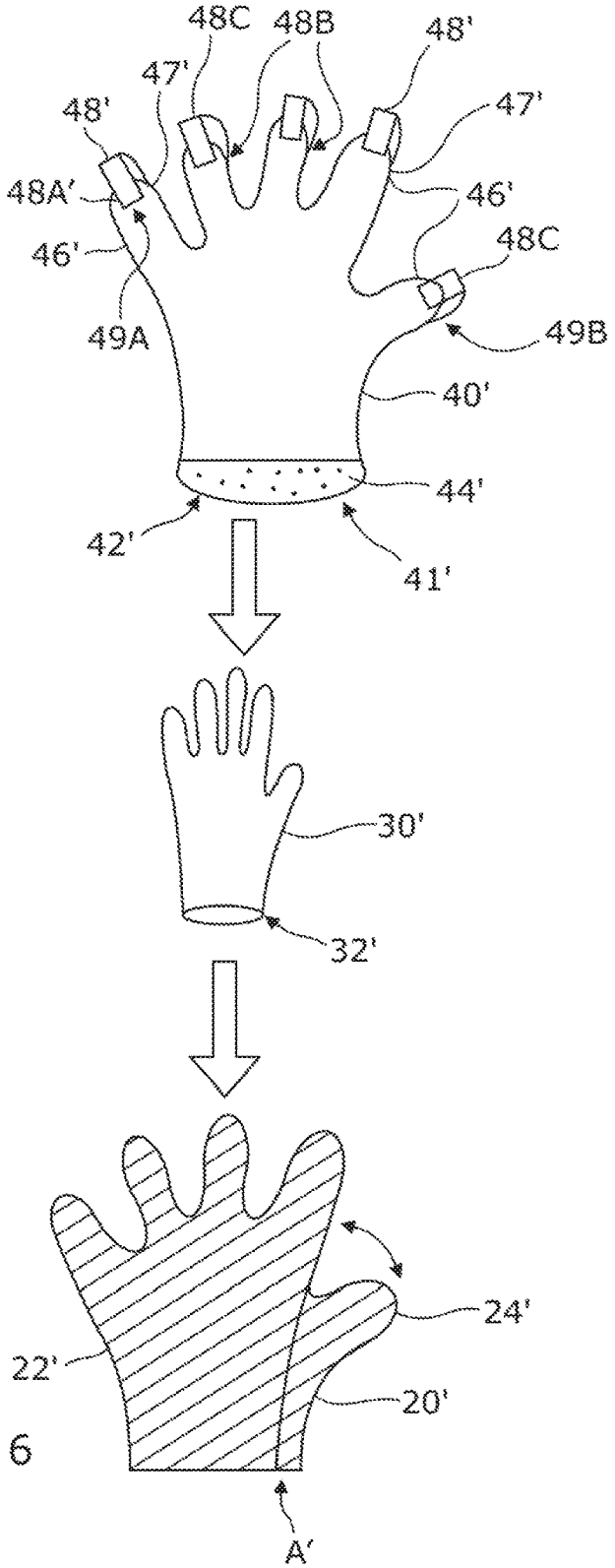
FIG. 6 is a schematic illustration of components of a novel component glove part for forming a breathable waterproof glove being sequentially inserted over an oversized glove former in accordance with a second embodiment of the method of the present invention.
Figure 7:
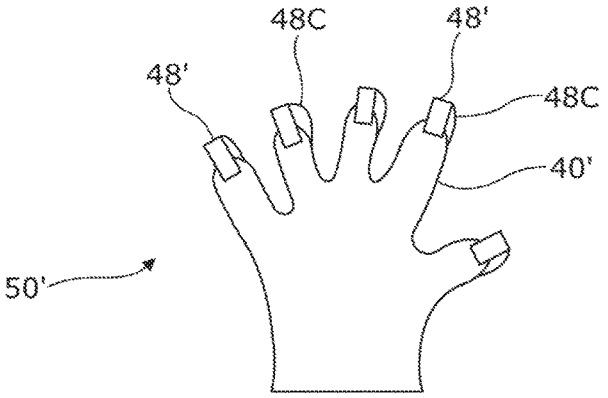
FIG. 7 shows the components of the novel component glove part of FIG. 6 following a laminating step.
Figure 8A:
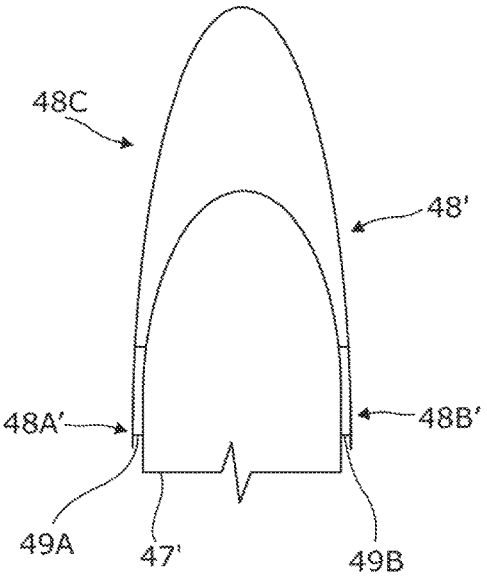
FIGS. 8A and 8B shows in detail the securement tab arrangement used in the novel component glove part of FIG. 6.
Figure 8B:
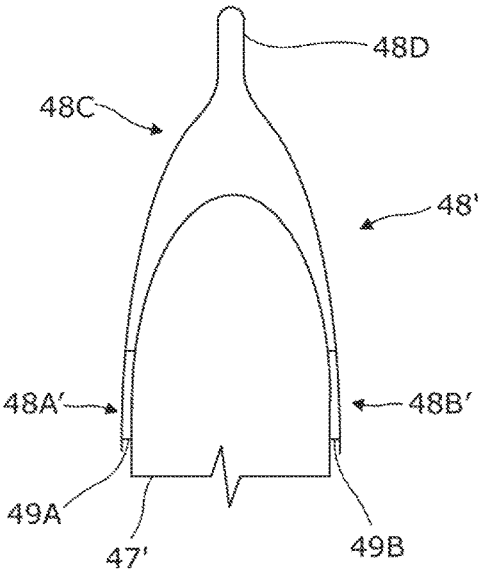

Component glove part 50' is assembled into a final glove in accordance with method steps 4-5 (FIGS. 4-5) of the first embodiment. As illustrated in FIG. 8B, loop 48C includes a central part 48D spaced from tip portion 47' and configured to be connected to a respective finger portion of an outer glove layer by a sewn connection (not shown).

Figure 9:
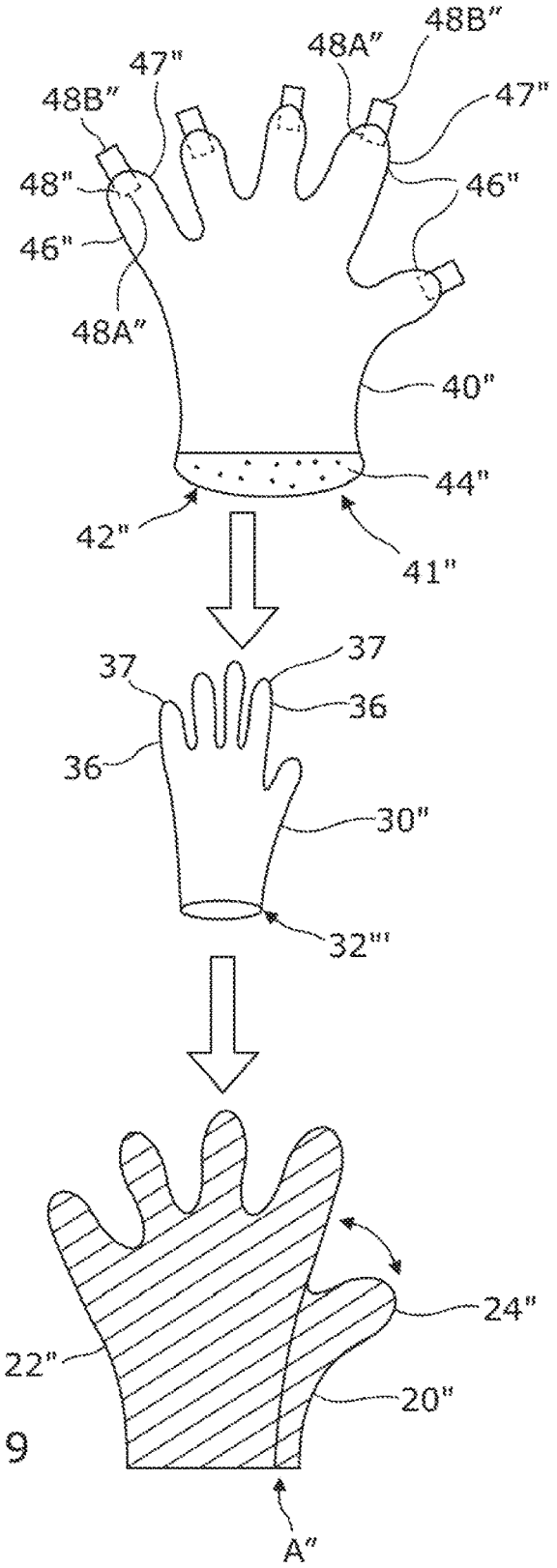
FIG. 9 is a schematic illustration of components of a novel component glove part for forming a breathable waterproof glove being sequentially inserted over an oversized glove former in accordance with a second embodiment of the method of the present invention.
Figure 10:
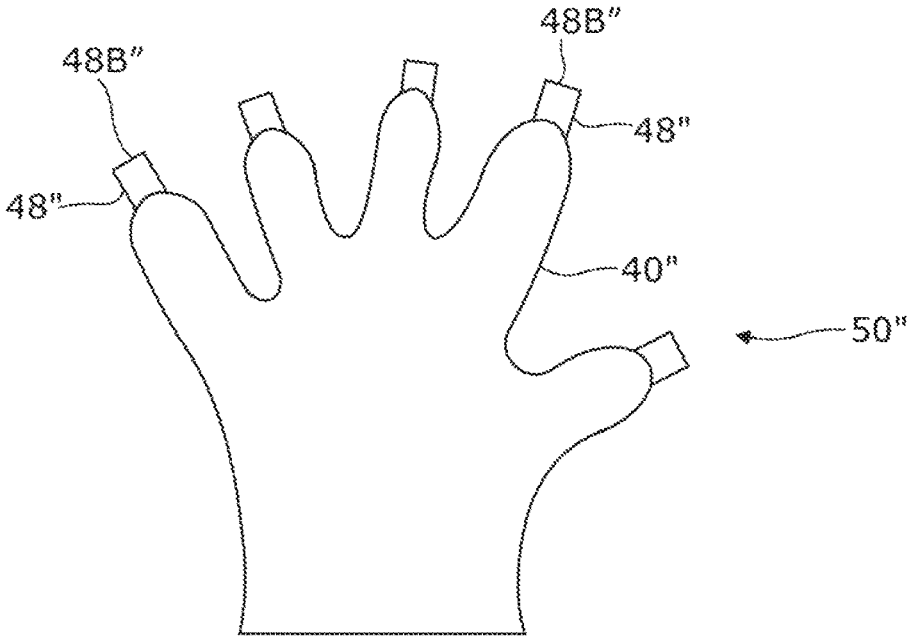
FIG. 10 shows the components of the novel component glove part of FIG. 9 following a laminating step.
Figure 11:
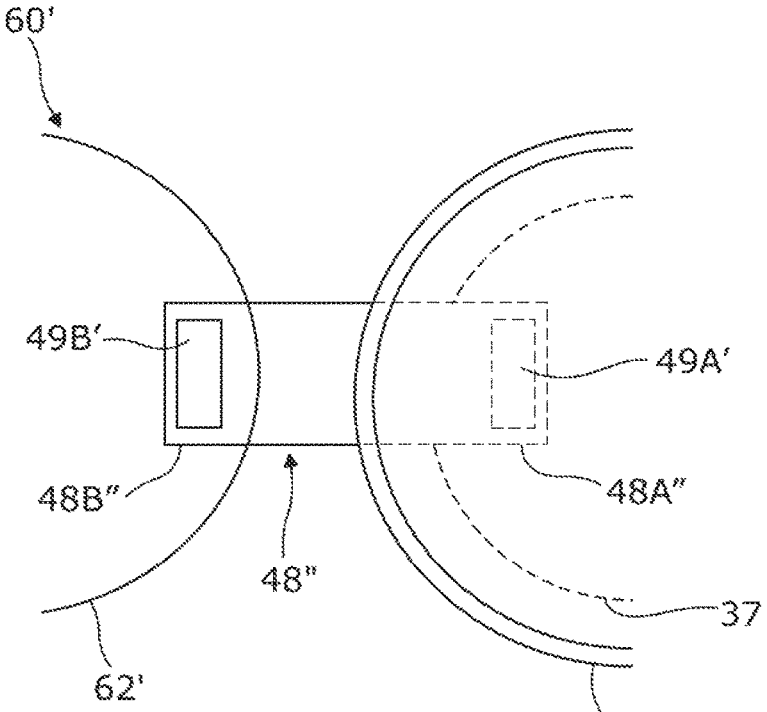
FIG. 11 shows in detail the securement tab arrangement used in the novel component glove part of FIG. 9.

FIGS. 9-11 show a method for sequentially forming two layers of a component glove part 50" according to a third embodiment of the present invention based on the method of FIGS. 1-3 (features in common with the first embodiment are labelled accordingly). Component glove part 50" differs from component glove part 50 in that each elastic fabric securement tab 48" extends through its respective finger portion 46" of intermediate glove layer 40" and has a first end 48A" connected by means of a first sewn connection 49A' to a tip portion 37 of a respective one of a plurality of finger portions 36 defined by inner glove layer 30 and a second end 48B" configured to be connected by means of a second sewn connection 49B' to a respective finger portion 62' of outer glove layer 60' (see FIG. 11 showing outer glove layer 60' inverted during formation of the second sewn connection 49B').

In this embodiment, intermediate glove layer 40" is formed by connecting discrete front and rear membrane parts each defining respectively front and rear sections of the plurality of fingers portions 46" and each securement tab 48" extending through the intermediate glove layer 40" is positioned between the discrete front and rear membrane parts prior to a step of welding the discrete front and rear membrane parts together. In this way, securement tabs 48" are fused to plurality of finger portions 46" during the step of connecting the discrete front and rear membrane parts to form a waterproof connection. As with component glove part 50', the tendency for elastic fabric securement tab 48" to damage or pull away from intermediate glove layer 40" is advantageously reduced in this arrangement.

Component glove part 50" is assembled into a final glove in accordance with method steps 4-5 (FIGS. 4-5) of the first embodiment.

FIGS. 12-15 illustrate a method of manufacturing a novel three-layer waterproof, windproof breathable glove 110.

Figure 12:
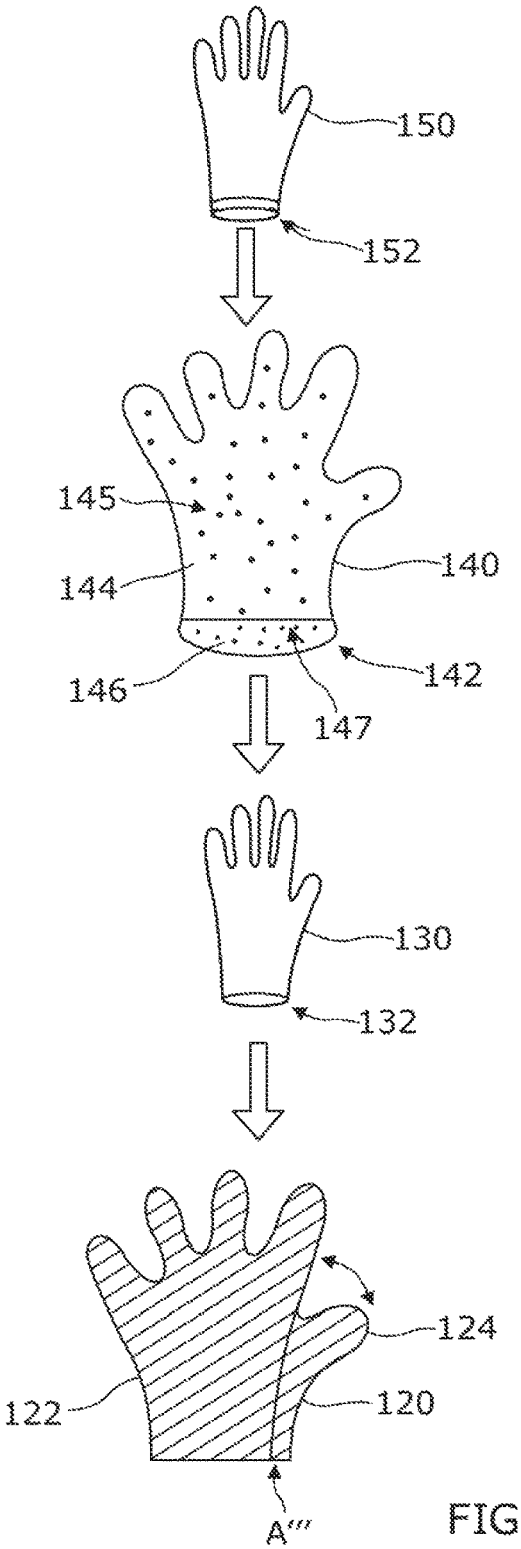
FIG. 12 is a schematic illustration of components of a novel three-layer glove being sequentially inserted over an oversized glove former in accordance with an embodiment of the method of the present invention.
Figure 13:
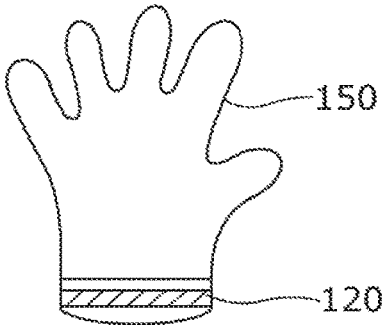
FIG. 13 shows the components of the novel glove of FIG. 12 assembled in position over the oversized glove former.
Figure 14:
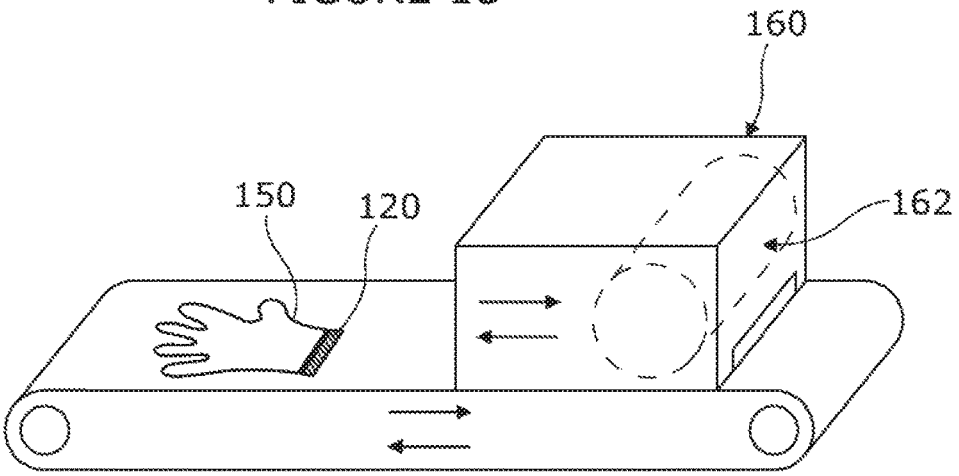
FIG. 14 is a schematic illustration of a laminating step in accordance with an embodiment of the method of the present invention.

As shown in FIG. 12, a first stage of the method comprises sequentially forming the three component layers of glove 110 on a planar oversized glove former 120 comprising a main hand portion 122 and a hinged thumb portion 124 pivotable relative to the main hand portion 122 about a pivot axis "A"" between a laterally extended position (as shown) in which thumb portion 124 extends away from main hand portion 122 and a folded position in which with thumb portion 124 is positioned beneath main hand portion 122. In the illustrated embodiment, oversized glove former 120 is at least 30% larger than eventual glove 110 in both planar dimensions.

In step one, an elastic, stretchable water permeable knitted outer glove layer 130 having approximately the same profile as the eventual glove 110 (including an opening 132 for receiving a user's hand) is stretched over the oversized glove former 120, the hinged thumb portion 124 is retracted inwards into the folded position to allow outer glove layer 130 to be stretched over oversized glove former 120 without causing damage to the knit, or localised overstretching of the outer glove layer 130. Outer glove layer 130 is intended in use to provide the outermost layer of glove 110 and may be formed from a single continuous (e.g. seamless) warp knitted layer.

In step two, a flexible intermediate glove layer 140 of limited stretchability relative to the outer glove layer 130 and having approximately the same profile (including an opening 142 for receiving a user's hand) as oversized glove former 120 is drawn over outer glove layer 130, again with hinged thumb portion 124 in the folded position to allow intermediate glove layer 140 to be placed over outer glove layer 130 without damaging intermediate glove layer 140 which is a snug fit around oversized glove former 120 when the hinged thumb portion 124 is in the extended position. Intermediate glove layer 140 comprises an inelastic membrane (typically 30-40 microns thick) resistant to penetration by liquid water but permeable to water vapour perspiration (e.g. a hydrophilic polyurethane membrane or microporous hydrophobic polyurethane membrane of types known in the art). Intermediate glove layer 140 includes inner and outer surfaces 144, 146 on which are printed first and second discontinuous patterns (e.g. dots, a network, lines or a combination thereof) of water based co-polyamide heat activatable adhesive, or other types of adhesive known in the art (e.g. powder coat or hot-melt types) 145, 147 respectively. The membrane may be formed from a plurality of shaped membrane sheets welded together (e.g. radio frequency, ultrasonic or hot-bar welded). An outer perimeter of intermediate glove layer 140 is additionally welded to form a watertight seal.

In step three, a stretchable water permeable knitted inner glove layer 150 having approximately the same profile (including an opening 152 for receiving a user's hand) as the eventual glove 110 is stretched over intermediate glove layer 140 (again with hinged thumb portion 124 in the folded position). The inner glove layer 150 is intended in use to provide the innermost layer of glove 110 and like the outer glove layer 130 may be formed from a single continuous warp knitted layer. Since the inner glove layer 150 is likely to be contact with a wearer's skin, this layer will typically configured to wick moisture away from the wearer (with water vapour being allowed to escape through intermediate glove layer 140). Once inner glove layer 150 has been stretched over intermediate glove layer 140, thumb portion 124 of oversized glove former 120 is pivoted back into the extended position to form the arrangement shown in FIG. 13 with all three glove layers 130, 140, 150 mounted sequentially on oversized glove former 120. Oversized glove former 120 with the three glove layers 130, 140, 150 mounted thereon is then passed through a laminating machine 160 in which first and second discontinuous patterns of heat activatable adhesive 145, 147 are activated by heat. Pressure is than applied by one or more rollers 162 to squeeze the softened adhesive into the knit of the fabric of the outer and inner glove layers 130, 150.

Figure 15:
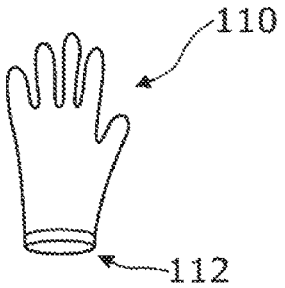
FIG. 15 shows the final novel product formed following the steps illustrated in FIGS. 12-14.

After lamination, hinged thumb portion 124 of oversized glove former 120 is pivoted to the folded position to enable the resulting article to be removed from oversized glove former 120, at which point the outer and inner glove layers 130, 150 will retract slightly by the pulling in of the fabric knit. Once the article has cooled, it is then put through a shrinking process including with the inner glove layer 150 outermost filling the glove with water to wet the outer glove layer 130 but not the inner glove layer 150 (this step will advantageously additionally check for leaks without requiring a separate leak testing step), removing some of the moisture mechanically and then exposing the article to heat (e.g. in a tumble dryer) to form glove 110 (including an opening 112 for receiving a user's hand) as shown in FIG. 15. After a predetermined period of drying, glove 110 is removed from the heat. The shrinking of the outer and inner glove layers 130, 150 has now resulted in folding of the inelastic intermediate glove layer 140 and also closed the knit of both the outer and inner glove layers 130, 150 to their original knitted shapes. Outer and inner glove layers 130, 150 can now be stretched back to their pre-laminated stretched configurations without applying any stress to intermediate glove layer 140.

The invention claimed is:

1. A breathable waterproof glove comprising:

an inner glove layer;

an outer glove layer; and an intermediate glove layer provided in a folded configuration between the inner and outer glove layers, the intermediate glove layer being resistant to penetration by liquid water but permeable to water vapour;

wherein:

the intermediate glove layer is attached to the inner glove layer by regions of adhesive provided at a plurality of discrete securement locations; and the intermediate glove layer and outer glove layer define a first and second plurality of finger portions respectively, with each one of the first plurality of finger portions being attached to a respective one of the second plurality of finger portions;

wherein each one of the first plurality of finger portions is attached to a respective one of the second plurality of finger portions by a respective interconnecting securement tab connected to its respective one of the first plurality of finger portions at first and second mutually spaced locations to form a loop, the first and second mutually spaced locations being on opposed sides of their respective one of the first plurality of finger portions, wherein the first of the mutually spaced locations is on a front side of the respective one of the first plurality of finger portions adjacent to a palm side of a finger-tip of a wearer and the second of the mutually spaced locations is on a rear side of the respective one of the first plurality of finger portions adjacent to a dorsal side of the finger-tip the wearer when worn, and wherein each securement tab is connected at a central part of the loop to its respective one of the second plurality of finger portions, with the central part of the loop being spaced from its respective one of the first plurality of finger portions by an opening.

2. A breathable waterproof glove according to claim 1, wherein each securement tab extends through the intermediate glove layer.

3. A breathable waterproof glove according to claim 2, wherein each securement tab is connected at a first end to a respective one of a third plurality of finger portions formed on the inner glove layer in registration with the first plurality of the finger portions.

4. A breathable waterproof glove according to claim 2, wherein each securement tab extends between first and second discrete parts forming the intermediate glove layer and each securement tab is welded to the first and second discrete parts.

5. A breathable waterproof glove according to claim 1, wherein the securement tabs are formed from an elastic fabric.

6. A breathable waterproof glove according to claim 5, wherein the elastic fabric is an elastic woven fabric or elastic fabric tape.

7. A breathable waterproof glove according to claim 1, wherein each securement tab is connected to its respective one of the first plurality of finger portions at the first and second mutually spaced locations by first and second adhesive connections respectively.

8. A breathable waterproof glove according to claim 1, wherein each securement tab is connected to its respective one of the second plurality of finger portions by a sewn connection.

9. A component part for forming a breathable waterproof glove, the component part comprising:

an intermediate glove part defining a first plurality of finger portions, the intermediate glove part comprising:

an inner glove layer; and an intermediate glove layer provided in a folded configuration adjacent the inner glove layer, the intermediate glove layer being resistant to penetration by liquid water but permeable to water vapour, wherein the intermediate glove layer is attached to the inner glove by regions of adhesive provided at a plurality of layer discrete securement locations;

wherein each of the first plurality of finger portions has attached thereto a securement tab for connecting the intermediate glove part to an outer glove part, each securement tab being connected to its respective one of the first plurality of finger portions at first and second mutually spaced locations to form a loop having a central part configured for attaching each securement tab to an outer glove layer, the first and second mutually spaced locations being on opposed sides of their respective one of the first plurality of finger portions with the central part of the loop being spaced from its respective one of the first plurality of finger portions by an opening, and wherein the first of the mutually spaced locations is on a front side of the respective one of the first plurality of finger portions adjacent to a palm side of a finger-tip of a wearer and the second of the mutually spaced locations is on a rear side of the respective one of the first plurality of finger portions adjacent to a dorsal side of the finger-tip of the wearer when worn.

10. A component part for forming a breathable waterproof glove according to claim 9, wherein the securement tabs are formed from an elastic material.

11. A component part for forming a breathable waterproof glove according to claim 9, wherein each securement tab is connected to its respective one of the first plurality of finger portions at the first and second mutually spaced locations by first and second adhesive connection respectively.

12. A component part for forming a breathable waterproof glove according to claim 9, wherein each securement tab extends through the intermediate glove layer.

13. A component part for forming a breathable waterproof glove according to claim 12, wherein each securement tab is connected at a first end to a respective one of a further plurality of finger portions formed on the inner glove layer in registration with the first-defined plurality of finger portions.

14. A component part for forming a breathable waterproof glove according to claim 13, wherein each securement tab extends between first and second discrete parts forming the intermediate glove layer and each securement tab is welded to the first and second discrete parts.

* * * * *